US006026519A

United States Patent [19]

Kaluza

[11] Patent Number: 6,026,519

[45] Date of Patent: Feb. 22, 2000

[54] MALE URINAL APPARATUS

[76] Inventor: Margaret A. Kaluza, P.O. Box 4093, Williston, N. Dak. 58801

[21] Appl. No.: 09/209,073

[22] Filed: Dec. 10, 1998

Related U.S. Application Data

[63] Continuation of application No. 08/775,647, Dec. 31, 1996.

[51] Int. Cl.[7] ..... A47K 11/12

[52] U.S. Cl. ..... 4/144.1

[58] Field of Search ..... 4/144.1

[56] References Cited

U.S. PATENT DOCUMENTS

| | | | |
|---|---|---|---|
| 2,292,055 | 8/1942 | Collins et al. | 4/144.1 X |
| 2,296,700 | 9/1942 | Branstetter et al. | 220/481 |
| 3,568,217 | 3/1971 | Anderson | 4/144.1 |
| 3,963,020 | 6/1976 | Hall | 4/144.1 |
| 4,117,845 | 10/1978 | Brown | 4/144.1 |
| 4,121,306 | 10/1978 | Bringman et al. | 4/144.2 |
| 4,267,700 | 5/1981 | Minter | 206/519 X |
| 4,309,779 | 1/1982 | Knight | 4/144.3 |
| 4,359,786 | 11/1982 | Rosberg et al. | 4/144.1 |
| 4,529,092 | 7/1985 | Swingley, Jr. | 206/593 |
| 4,848,622 | 7/1989 | Kroetsch | 220/90.4 |
| 4,937,889 | 7/1990 | Strickland | 4/144.3 |
| 4,946,058 | 8/1990 | Stamm | 220/23.83 |
| 5,282,599 | 2/1994 | Arpaia | 4/144.1 X |
| 5,381,922 | 1/1995 | Gladman et al. | 220/481 |
| 5,386,910 | 2/1995 | Liss | 206/554 |
| 5,406,651 | 4/1995 | Nogay | 4/144.3 |
| 5,454,483 | 10/1995 | Ichikawa et al. | 220/737 |
| 5,531,238 | 7/1996 | Azzarelli et al. | 220/482 X |

FOREIGN PATENT DOCUMENTS

| | | |
|---|---|---|
| 4022284 | 2/1991 | Germany . |
| 5210909 | 1/1977 | Japan . |

*Primary Examiner*—Robert M. Fetsuga
*Attorney, Agent, or Firm*—Chrisman Bynum & Johnson; James R. Young

[57] ABSTRACT

A male urinal device comprising a housing which includes a top wall portion, a bottom wall portion, and a plurality of side wall portions which define an interior urine-retention chamber. An entrance opening in a first side wall portion is positioned adjacent the top wall portion, the entrance opening being slightly angularly disposed with respect to the vertical axis of the housing to facilitate entry of an upwardly directed stream of urine therein, and to facilitate entry of the penis for urination without (or with only minimal) tipping of the urinal. The urinal includes a urine deflector formed by a portion of the top wall portion of the housing and positioned adjacent the entrance opening, the urine deflector being adapted for capturing the stream of urine and deflecting the stream downwardly and into the urine-retention chamber. Also disclosed is a urinal holder comprising a rigid container having an open upper end, a bottom wall section, and a plurality of side wall sections. An aperture in a first side wall section of the holder is adapted to receive a handle of a male urinal. The urinal holder includes a fastener for attaching the container to a support structure or surface, such as a bed, bed stand, table or wall.

12 Claims, 7 Drawing Sheets

MALE URINAL APPARATUS

CROSS-REFERENCE TO RELATED APPLICATION

The present application is a continuation of U.S. patent application Ser. No. 08/775,647 for "MALE URINAL APPARATUS" filed Dec. 31, 1996, incorporated herein by this reference in its entirety.

BACKGROUND OF THE INVENTION

1. Field of the Invention

The present invention relates generally to devices for receiving urine from patients and, more particularly, to devices especially adapted for receiving urine from male patients.

2. Description of the State of the Art

Various urinal devices have been developed for collecting urine from bedridden patients. Conventional portable urinals or bed pans for male patients usually comprise a cylindrical sleeve or spout with an opening extending generally upwardly from a covered fluid receptacle or pan for collecting the discharged urine. Such urinals have remained relatively unchanged over the years with only slight variations in configuration and angular orientation of the components. While existing designs are generally effective and capture a significant portion of the discharged urine, all suffer to some extent from leakage and spillage problems, especially when the male patient has to remain in a supine position while urinating. Leakage frequently results, for example, during discharge due to misdirection of the urine stream. The upwardly oriented sleeve or spout requires that the urinal or bed pan be tipped substantially to accommodate entry of the penis for urination, but the extent to which the urinal can be tipped in this manner is limited by the practical necessity of also having to retain the urine in the receptacle without pouring it out. Therefore, it is usually difficult, if not impossible, to orient the sleeve or spout to optimally accommodate entry of the penis. This limitation, along with the physiological fact that the penis often contracts when inserted into urinal devices results in diverting the urine stream upward in a manner that often overshoots the urinal opening, either partially or entirely, thus soiling the patient and bed clothes.

Spillage of collected urine also frequently occurs while transporting and emptying conventional male urinals. While many such urinals include lids which facilitate retention of collected urine within the urine receptacle, the lids are typically either separate from the device or attached to a handle above the receptacle. When the lid is separate, to avoid spillage, the patient or an attendant must affix the lid to the urinal before attempting to remove the device from the patient's bed. Some patients, such as those with arthritis, do not have adequate finger agility for securing the lid, particularly lids of the screw-on type. Alternatively, when the lid is attached to the handle of the urinal, the device is generally cumbersome and difficult to manipulate. Thus, neither of these conventional designs facilitates removal of the urinal from the patient's bed without spillage of collected urine.

Finally, male urinal devices currently in use are not adapted to being hung from the side of a bed or bed stand. For ease of accessibility, however, it would be desirable for a urinal device to be adapted for hanging from the side of a bed, such as from a bed rail, or from a bed stand, night table or wall. In addition to being convenient and accessible to the patient and/or his attendant, such a device could be quickly located and removed from the area by medical personnel in the event of an emergency, e.g., during a "code blue" procedure.

A need therefore exists for a male urinal device which is simple in design, easy and convenient to use, sanitary, and which eliminates or minimizes leakage and spillage of discharged urine.

SUMMARY OF THE INVENTION

Accordingly, it is an object of the present invention to provide a portable urinal or bed pan for men which is simple in design and easy to use.

Another object of the present invention is to provide a portable urinal for men which minimizes leakage of urine during discharge.

A more specific object of the present invention is to provide a male urinal device which minimizes the risk of leakage caused by a misdirected urine stream, especially when collecting urine from a male in a supine position.

A further object of the present invention is to provide a portable urinal for men which minimizes the risk of spillage of collected urine from the urine receptacle.

A yet further object of the present invention is to provide a urinal holder which is adapted for hanging from the side of a structure, such as a bed, bed stand, night table or wall.

Additional objects, advantages and novel features of this invention shall be set forth in part in the following description taken in conjunction with the accompanying drawings forming a part of this specification, and in part will become apparent to those skilled in the art upon examination of the specification or may be learned by the practice of the invention. Those skilled in the art will appreciate that the invention described herein is susceptible to many modifications and variations without departing from its scope as defined by the appended claims.

To achieve the foregoing and other objects and in accordance with the purposes of the present invention, as embodied and broadly described herein, the urinal apparatus of this invention comprises a housing adapted for receiving urine having a top wall portion, a bottom wall portion, and a plurality of side wall portions. A first side wall portion has an entrance opening, adjacent the top wall portion, which is slightly angularly disposed with respect to the vertical axis of the housing to facilitate entry of an upwardly directed stream of urine therein, and to facilitate entry of the penis for urination without having to tip the urinal. A urine deflector, formed in the top wall portion of the housing adjacent the entrance opening, captures the urine stream and deflects the stream downward into the housing. The present invention also includes a urinal holder comprising a rigid container, wherein the container has an aperture in a side wall section for receiving a handle of a male urinal and a fastener for attaching the container to a support structure such as a bed, bed stand, night table or wall.

BRIEF DESCRIPTION OF THE DRAWINGS

The accompanying drawings, which are incorporated herein and form a part of the specification, illustrate preferred embodiments of the present invention and, together with the description, serve to explain the principles of the invention.

In the drawings.

DETAILED DESCRIPTION OF THE PREFERRED EMBODIMENT

Figure 1:
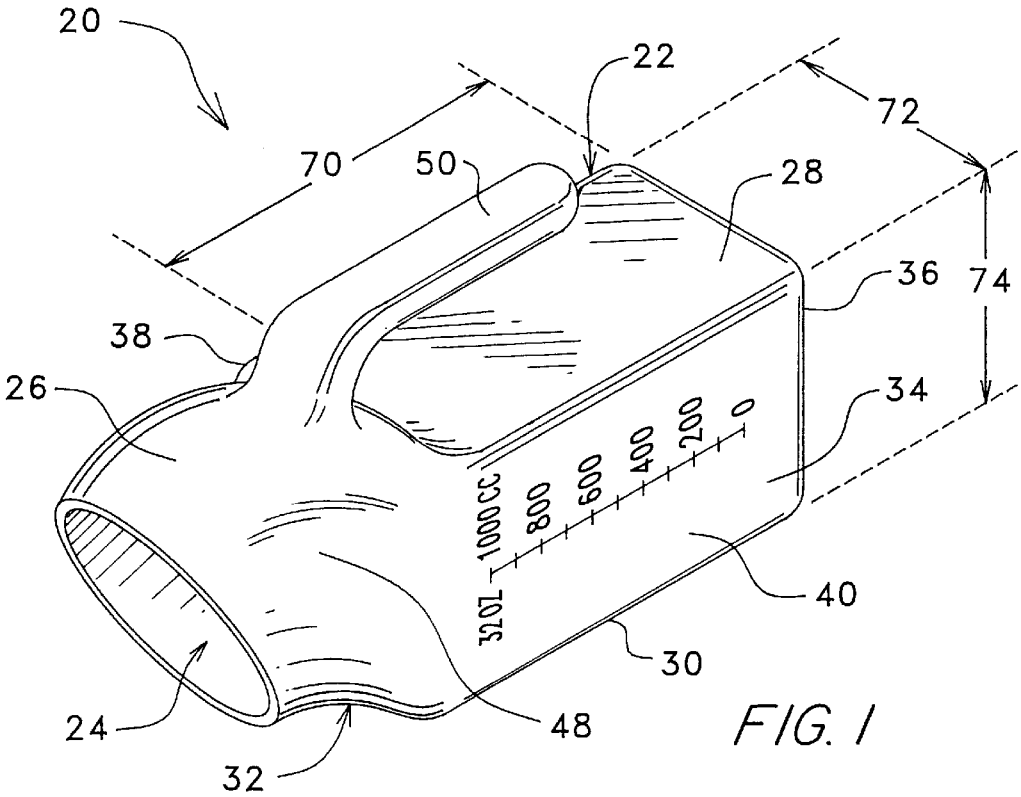
FIG. 1 is a perspective view of the male urinal apparatus of the present invention.

Referring now to the drawings, like numbers indicate like features and the same number appearing in more than one figure refers to the same element.

FIGS. 1 through 4 illustrate exemplary embodiments of the male urinal apparatus 20 of the present invention. The male urinal apparatus 20 includes a housing 22 for receiving and collecting urine; an entrance opening 24 which is slightly angularly disposed, as indicated by arrow A, with respect to the vertical axis 44 of the housing 22 to facilitate entry of a stream of urine therein, including a substantially upwardly directed urine stream (42 in FIG. 3); and a urine deflector 26 formed by a portion of the top wall 28 of the housing 22 adjacent the entrance opening 24 for capturing and deflecting the urine stream 42 downwardly and into the housing 22.

The male urinal apparatus 20 comprises a housing 22 which includes a top wall portion 28, a bottom wall portion 30, and a plurality of side wall portions (32, 34, 36 and 38) which define an interior urine-retention chamber 40. An entrance opening 24 in the first side wall portion 32 is slightly angularly disposed with respect to the vertical axis (44 in FIGS. 3 and 4) of the housing 22 to facilitate entry of a stream of urine therein, including a substantially upwardly directed urine stream 42. Although the exact diameter of the entrance opening 24 is not critical to the invention, the opening 24 is preferably substantially larger in cross-section than the penis P of the patient (shown in phantom lines in FIG. 3) to facilitate partial entry of at least the distal end of the penis P and capture of the urine stream. The angle A (shown in FIGS. 3 and 4) of the entrance opening 24 is generally in the range of about 1° to about 90°, preferably about 20° to about 30°, and most preferably about 25°.

A significant advantage associated with the urinal apparatus 20 of the present invention is that it minimizes the risk of leakage caused by a misdirected urine stream, especially when collecting urine from a male in a supine position. To use conventional urinals or bed pans while in a supine position, the urinal or bed pan must be tipped substantially to accommodate entry of the penis for urination. Unfortunately, the extent to which the urinal can be tipped in this manner is limited by the practical necessity of also having to retain the urine in the receptacle without spilling it out. This limitation, coupled with the physiological fact that the penis often contracts when inserted into urinal devices, often results in unintentionally diverting the urine stream upwardly in a manner that can overshoot the urinal opening, thus soiling the patient and bed clothes. The present invention resolves this problem by providing a urinal device 20 wherein the entrance opening 24 angles forwardly, thus facilitating entry of the penis P for urination without having to tip the urinal, at least not as much as conventional urinals have to be tipped. The urinal 20 of this invention is thus easy and convenient to use, even when the user is fully reclined or supine.

Figure 3:
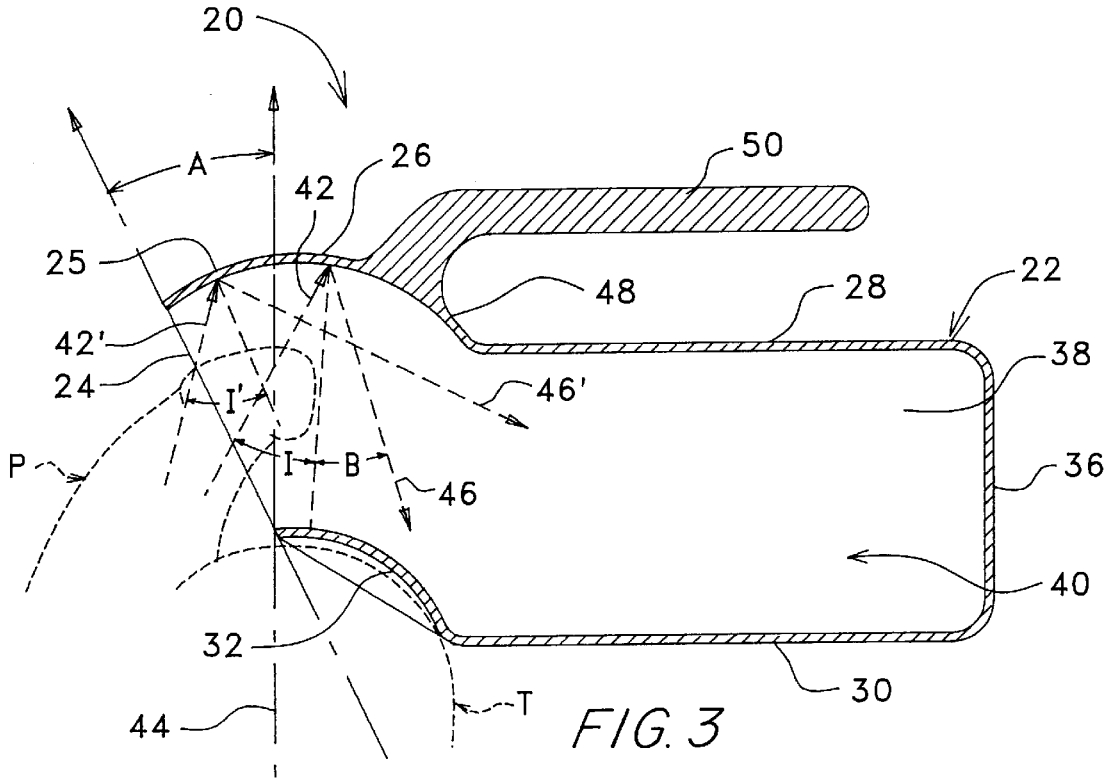
FIG. 3 is a cross-sectional view taken substantially along the line 3—3 of FIG. 2, showing the male urinal apparatus in an embodiment of the present invention.

Referring now to FIG. 3, the male urinal apparatus 20 includes a urine deflector 26, formed on or by the top wall portion 28 of the housing 22 adjacent the entrance opening 24, which further facilitates the capture and channeling of urine into the urine-retention chamber 40. An upwardly directed stream of urine 42 strikes the bottom surface of the urine deflector 26 and is deflected downwardly therefrom at an angle B, the exact angle B depending upon the angle of incidence I of the incoming urine stream 42 and the curvature of the urine deflector 26. As will be appreciated by those of skill in the art, angle B is always greater than 1° and less than 180°. Also as will be appreciated by those skilled in the art and as can be seen in the drawings herein, the distance between the bottom surface of the urine deflector 26 and the top surface of the first side wall 32 is generally larger than the diameter of the entrance opening 24. The radius of the urine deflector 26 is generally in the range of about 2" to about 3", preferably about 2¼" to about 2½", and most preferably about 2½". After the incoming stream of urine 42 strikes the urine deflector 26, it is deflected downwardly toward the bottom wall portion 30, where it collects in the interior urine-retention chamber 40. Depending upon the Angle B, the deflected urine stream 46 may strike the downwardly sloping first side wall 32, which then channels the deflected urine stream 46 into the interior urine-retention housing 40, or the deflected urine stream 46 may pass directly into the interior urine-retention housing 40 without striking first side wall 32.

Figure 2:
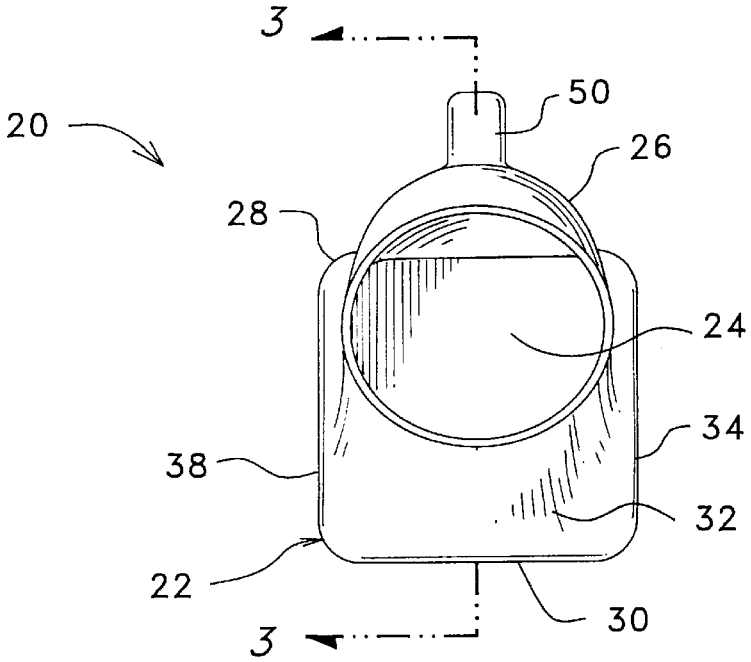
FIG. 2 is a front elevational view of the male urinal apparatus of the present invention.

In the preferred embodiment shown in FIGS. 1 and 2, the male urinal apparatus 20 comprises an elongated neck region 48 positioned between the entrance opening 24 and the urine-retention chamber 40. The elongated neck region 48 projects upward from the urine-retention chamber 40, thus minimizing the risk of spillage therefrom. In the preferred embodiment shown in FIG. 3, the proximal end portion 25 of the elongated neck region 48 tilts or slopes downwardly toward the entrance opening 24 of the housing 22 to further facilitate entry of an upwardly directed urine stream 42 from the penis P of a supine patient. This downward slope of the proximal end portion 25 also provides a larger angle of incidence I to capture a less carefully directed or misdirected urine stream 42' that strikes the deflector 26 closer to the entrance 24 so that the consequent deflected urine stream 46' is still captured into the interior of the urine-retention chamber 40 rather than being splattered back out of the opening 24. Also in the preferred embodiment, best seen in FIG. 3, the first side wall portion 32 of the housing 22 is concave between the entrance opening 24 and the bottom wall portion 30 to comfortably conform to the curvature of the patient's testicles T when the urinal 20 is placed in position for use as shown in FIG. 3. In this description, the words proximal and distal are used in relation to the patient user of the urinal 20.

The male urinal apparatus 20 of the present invention may include a handle 50 for manipulating the urinal 20 into place for use. The handle 50 extends from the top wall portion 28 of the housing 22, preferably in the region of the urine deflector 26, as illustrated in FIGS. 1, 3, and 4.

As shown in FIG. 1, the urine retention housing 22 includes a length dimension 70, a width dimension 72, and a height dimension 74. The length dimension 70 is greater than the width dimension 72, preferably about three times greater. The actual dimensions of the housing 22 define the urine-holding capacity of the interior urine-retention chamber 40 of the housing 22. In a preferred embodiment, the interior urine-retention chamber 40 has a urine-holding capacity of about 1,000 cc, although the exact capacity may vary to accommodate the needs of the particular user. For example, when the male user is a child, the urine-holding capacity may be reduced accordingly. In another preferred embodiment, as partially shown in FIG. 1, the housing 22 is graduated on side walls 34 and 38, and bottom wall portion 30.

Figure 4:
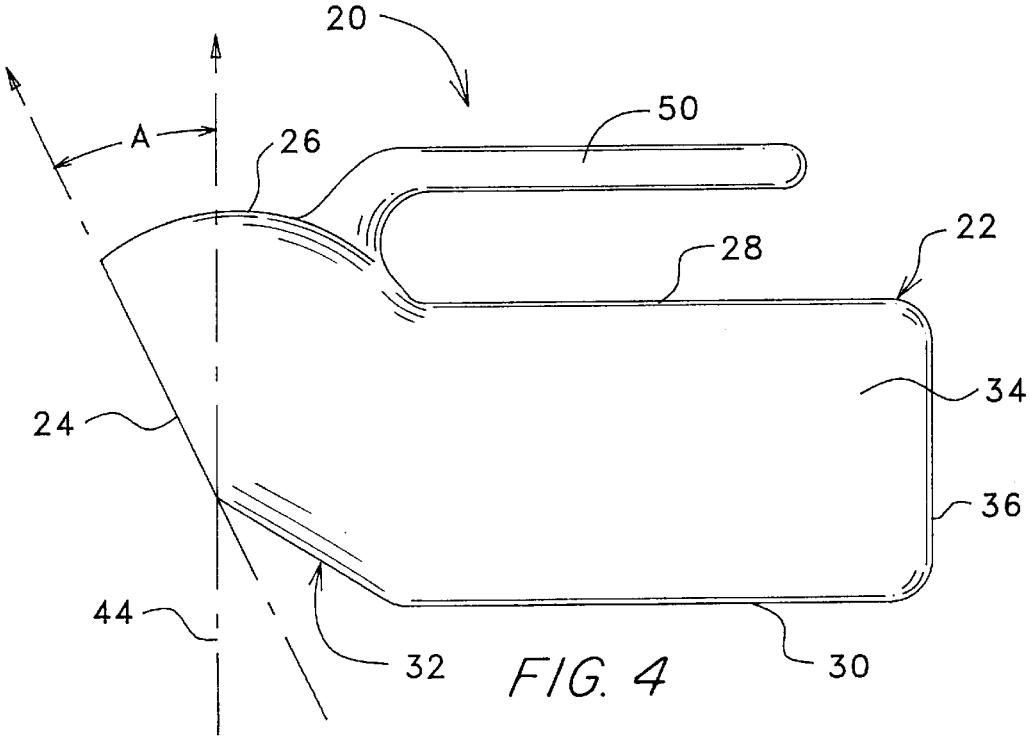
FIG. 4 is a side elevational view of the male urinal apparatus in an alternate embodiment of the present invention.

FIG. 4 illustrates an alternate embodiment of the urinal apparatus of the present invention. In this embodiment, the first side wall portion 32 of the housing 22 slopes downwardly from the entrance opening 24 toward the bottom wall portion 30 to facilitate channeling of the urine stream into the urine-retention chamber 40. However, in this embodiment, there is no concave section between the entrance opening 24 and the bottom wall portion 30 to conform to the curvature of the patient's testicles. This embodiment also lacks an elongated neck region 48 between the entrance opening 24 and the urine-retention chamber 40.

Figure 7:
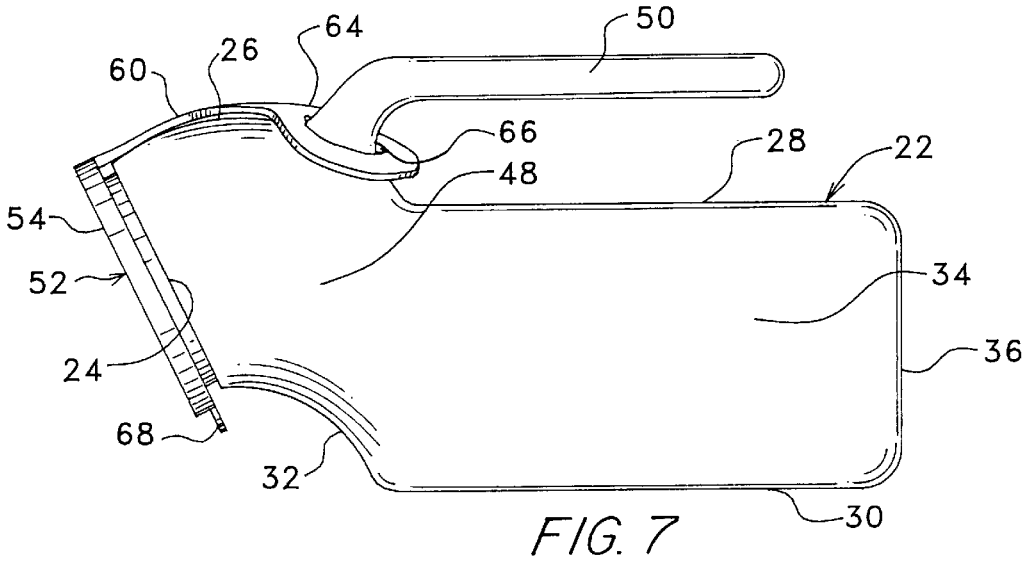
FIG. 7 is a side view of the male urinal apparatus having a lid attached to the handle, in an alternate preferred embodiment of the present invention.
Figure 6:
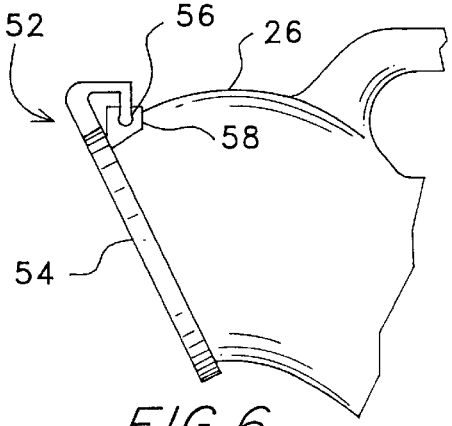
FIG. 6 is a partial side view of the male urinal apparatus of FIG. 5, showing the lid attached thereto.
Figure 5:
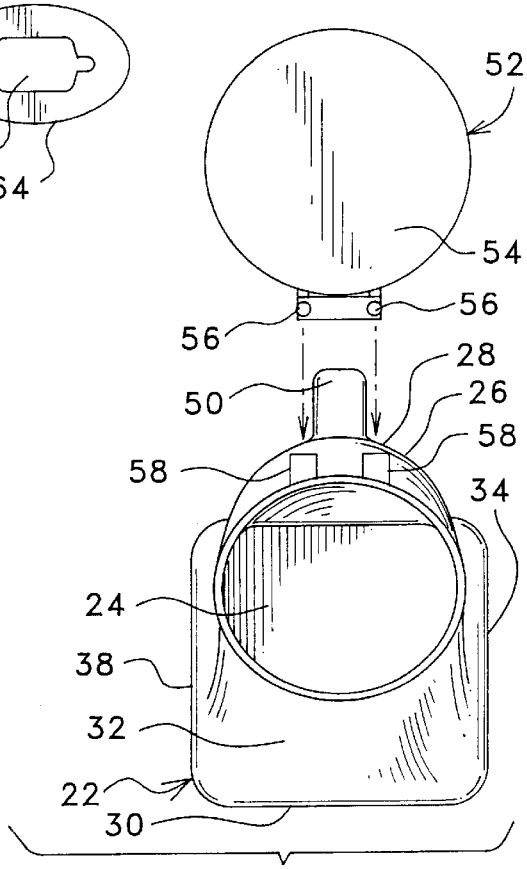
FIG. 5 is a front elevational view of the male urinal apparatus in an embodiment of the present invention showing the entrance opening and lid therefor.

The male urinal apparatus 20 may include a lid 52 for sealing the entrance opening 24, as exemplified in FIGS. 5 through 7. The lid 52 prevents loss of urine from the urine-retention chamber 40 during transport thereof, thereby eliminating the spillage which frequently occurs when transporting and emptying conventional urinals. In a first embodiment illustrated in FIGS. 5 and 6, the lid 52 includes a planar cover component 54 having a first mating element 56 attached thereto to provide a hinged pivotal attachment to the housing 22. The first mating element 56, such as a shaft or pin, may be releasably attached to a second mating element 58, such as a journal, which extends upwardly from the top wall portion 28 of the housing 22 immediately adjacent the entrance opening 24. In the embodiment shown in FIG. 5, the first mating element 56 snaps into position on the second mating element 58 using a releasable "snap"-type hinge made, for example, with a slightly yieldable, but resilient plastic, which is well known and readily available in the art. Preferably, the lid 52 is positioned on and attached to the housing 22 in such a manner that, when in the open position, the lid 52 opens completely and lies flat against the top wall portion 28 to provide unobstructed access to the entrance opening 24.

Figure 8:
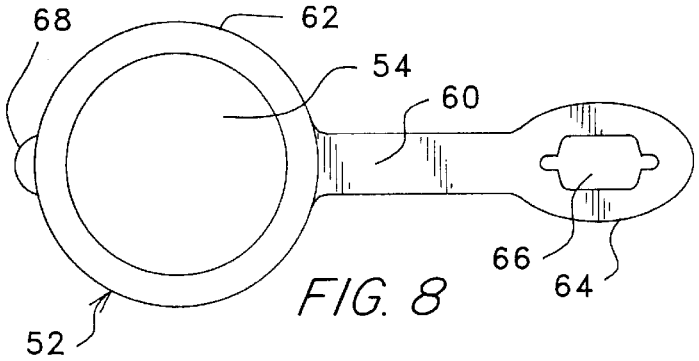
FIG. 8 is a top elevational view of a lid for the male urinal apparatus of the present invention.

In a second embodiment illustrated in FIGS. 7 and 8, the lid 52 is removably connected to the housing 22 by a tether 60. The tether 60 terminates in an enlarged end 64 having an aperture 66 disposed therein. The aperture 66 has an appropriate size and shape such that it can slide over the urinal handle 50 to provide a removable attachment thereto, as illustrated in FIG. 7. The lid 52 may include a continuous flange 62 (shown in FIG. 8) configured to frictionally engage and mate with the edges of the entrance opening 24. To readily attach and detach the lid 52, a tab 68 extends from the side of the lid 52 opposite the tether 60.

FIGS. 9 through 15 show exemplary embodiments of the urinal holder 100 of the present invention. The urinal holder 100 includes a rigid container 102 having an aperture 124 in a first side wall section 108 to receive a handle 50 of a male urinal 20. The male urinal 20 can be inserted into and housed within the urinal holder 100 in an upright position to prevent spillage of collected urine from the urinal 20 when not in use. The urinal holder 100 is adapted to be hung from, or secured to the surface of, a variety of support surfaces and structures (136 in FIGS. 13 and 15; 138 in FIG. 14), such as a bed rail, night table, bed stand, and the like. Moreover, the urinal holder 100 is releasably attached to the support surface or structure to facilitate quick removal therefrom during an emergency situation. The urinal holder 100 thus provides a sanitary, convenient, and accessible mechanism for storing a portable urinal 20.

Figure 9:
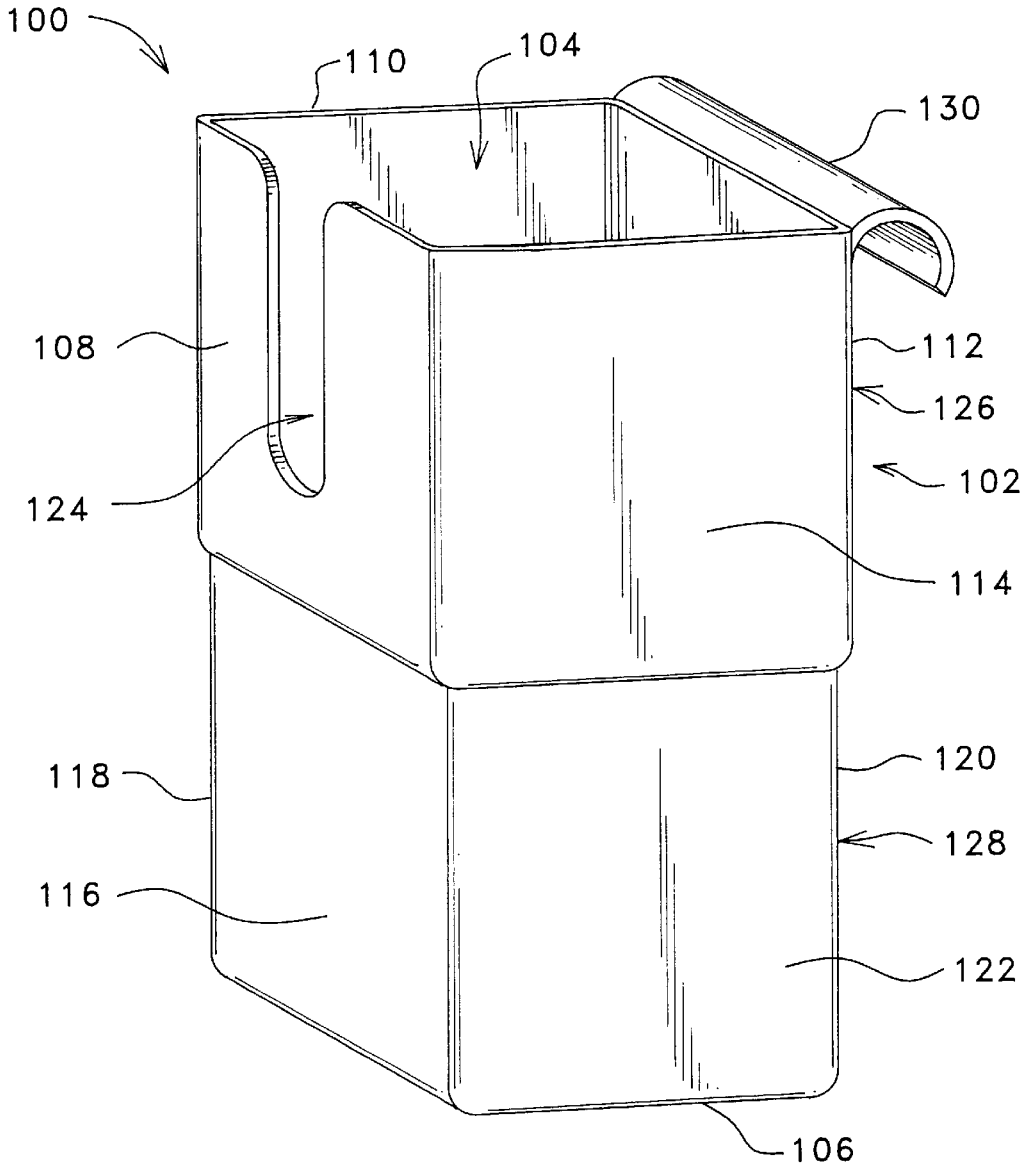
FIG. 9 is a perspective view of the urinal holder of the present invention.

FIG. 9 illustrates the urinal holder 100 in a preferred embodiment of the present invention. The urinal holder 100 comprises a rigid container 102 having an open upper end 104, a bottom wall section 106, and a plurality of side wall sections (108 through 114 and 116 through 122). The holder has an aperture 124 in the first side wall section 108 to accommodate the handle 50 (FIGS. 11 through 15) of a male urinal device 20. In the embodiment shown in FIG. 9, the aperture 124 is adjacent the open upper end 104 of the urinal holder 100 on the first side wall section 108 and extends downward therefrom. Although the exact size and configuration of the aperture 124 will depend upon the handle dimensions of the particular urinal device 20 to be housed, in the preferred embodiment shown in FIG. 9, the aperture 124 is generally oblong and the major axis of the oblong lies in the vertical plane. Also as exemplified therein, for safety purposes, the urinal holder 100 of the present invention preferably comprises rounded corners and edges.

As illustrated in FIGS. 9 and 12–15, in the preferred embodiment of the invention, the urinal holder 100 is stackable. In this preferred embodiment, the container 102 comprises a larger top segment 126 (comprising side wall sections 108 through 114) and a smaller bottom segment 128 (comprising side wall sections 116 through 122 and bottom wall section 106). The smaller bottom segment 128 is adapted to be retained within the larger top segment 126 of a second holder 100 (not shown) such that the holders 100 can be stacked when not in use.

Figure 10:
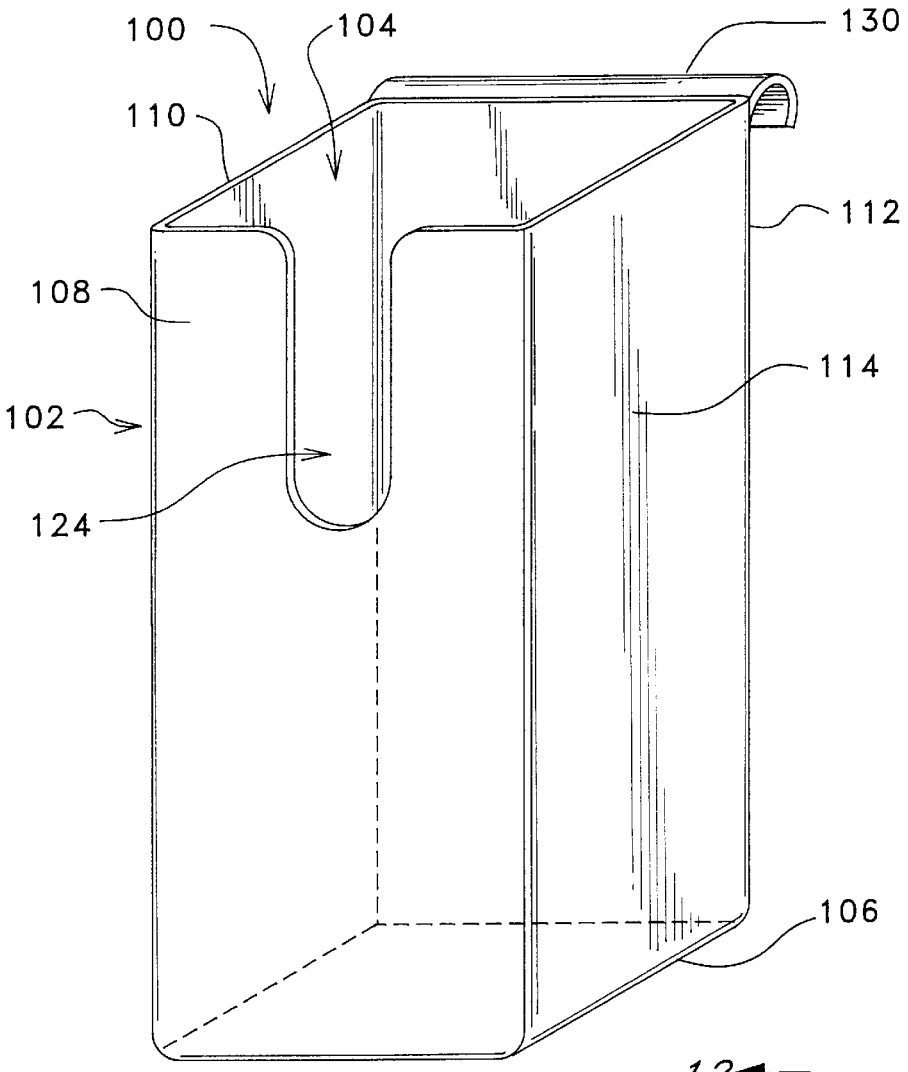
FIG. 10 is a perspective view of the urinal holder in an alternate embodiment of the present invention.
Figure 11:
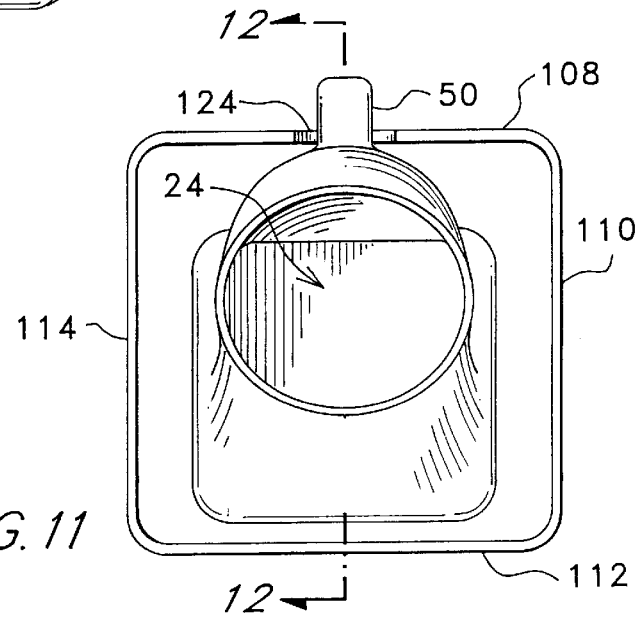
FIG. 11 is a top elevational view of the urinal holder of FIG. 9, showing a male urinal apparatus positioned therein.
Figure 12:
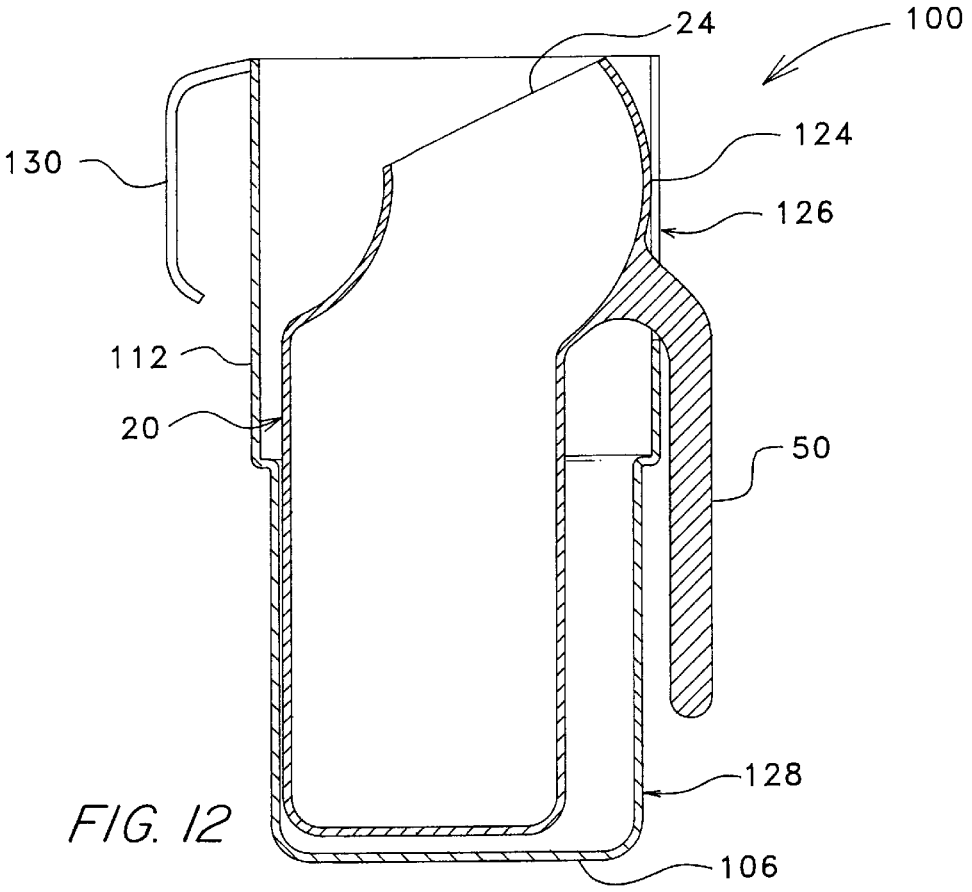
FIG. 12 is a cross-sectional view of the urinal holder taken substantially along the line 12—12 of FIG. 11, showing a male urinal apparatus positioned therein.

In an alternate embodiment, shown in FIG. 10, the container 102 of the urinal holder 100 comprises a simple box structure, which is not stackable. In this embodiment, the container 102 includes four side wall sections 108 through 114 and a bottom wall section 106.

Figure 13:
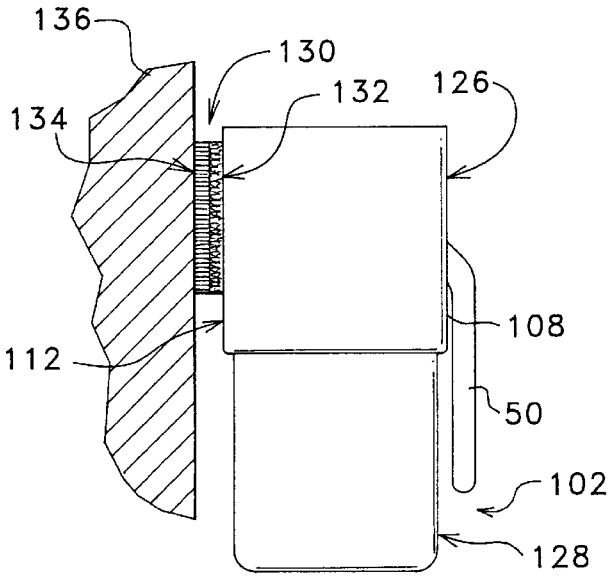
FIG. 13 is a side view of the urinal holder in a preferred embodiment of the present invention, showing the holder attached to a support surface, such as a wall.
Figure 14:
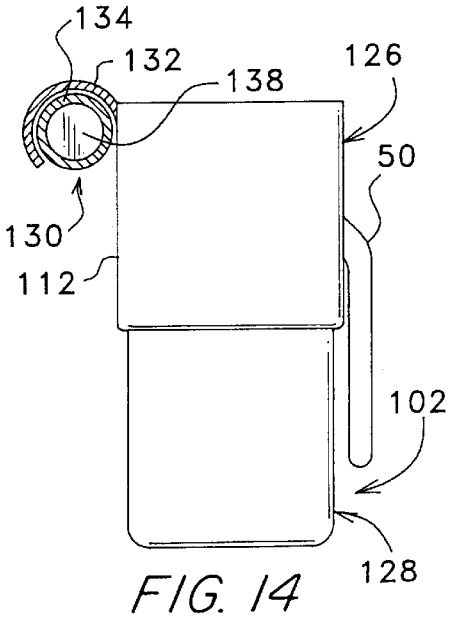
FIG. 14 is a side view of the urinal holder in an alternate preferred embodiment of the present invention, showing the holder attached to a support structure, such as a bed rail.
Figure 15:
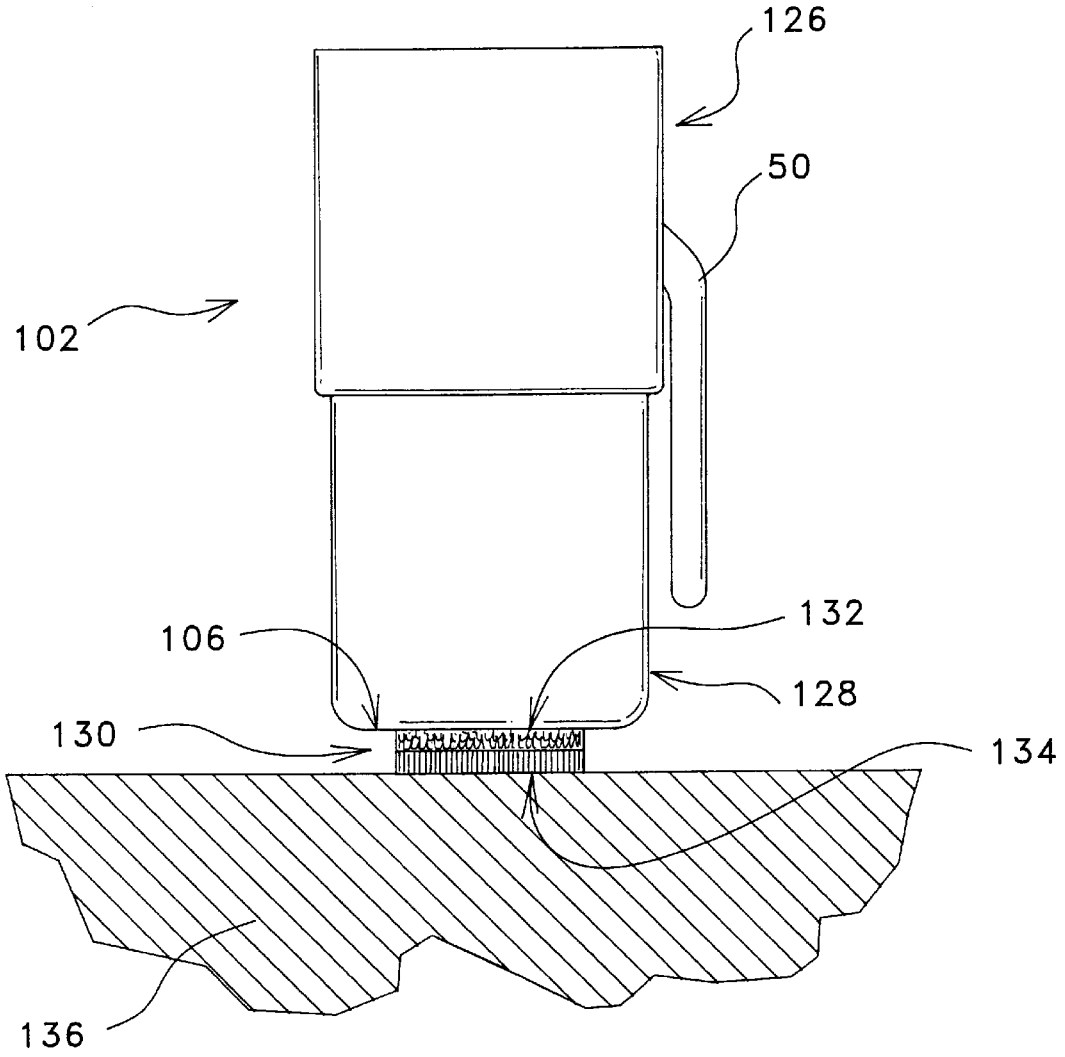
FIG. 15 is a side view of the urinal holder in another preferred embodiment of the present invention, showing the holder attached to a support surface, such as a table.

In the preferred embodiments shown in FIGS. 13, 14, and 15, the urinal holder 100 comprises a fastener 130 for attaching the container 102 to a support surface 136 (FIGS. 13 and 15) or a support structure 138 (FIG. 14). Although the fastener 130 may comprise any suitable fastening system known in the art, the preferred fastener 130 includes a mating loop pile fastener such as a Fastener sold under the trademark VELCRO. The fastener 130 includes a first attachment element 132, affixed to the external surface of the container 102, and a second attachment element 134 affixed to a support surface 136 (FIGS. 13 and 15) such as a bed stand, night table or wall, or a support structure 138 (FIG. 14), such as a bed rail. The second attachment element 134 includes an adhesive coating on the non-mating surface for securing the attachment element 134 to a variety of wood, metal and plastic surfaces. In the preferred embodiments, the first attachment element 132 is readily engaging with and readily releasable from the second attachment element 134. Although the fastener 130 is affixed to the side wall section 112 opposite the first side wall section 108 in the exemplified embodiments, the fastener 130 may be affixed to any external surface of the container 102 other than the first side wall section 108, as discussed in more detail below.

As will be appreciated by those of skill in the art, the container 102 can be secured to a vertical support surface (e.g., a night table or wall) when the first attachment element 132 of the fastener 130 is positioned on a side wall section (110, 112 or 114) of the container 102, as shown in FIG. 13. Alternatively, the container will hang from a vertical support structure (e.g., a bed rail or stand) when the first attachment element 132 is attached to the upper edge of side wall section (110, 112 or 114) of the container 102, as shown in FIG. 14. In yet a further embodiment, shown in FIG. 15, the container 102 can be secured to a horizontal support surface (e.g., a table top) when the first attachment element 132 of the fastener 130 is positioned on the bottom wall section 106 of the container 102. Thus, the urinal holder 100 can be positioned in any of a number of convenient locations, making the portable urinal 20 convenient and accessible to the patient and/or his attendant. Moreover, because the urinal holder 100 of the present invention is releasably attached to the support surface 136 or structure 138, the holder can be quickly removed from the vicinity by medical personnel in the event of an emergency, e.g., during a "code blue" procedure.

The urinal 20 and urinal holder 100 of the present invention can be constructed from any suitable material, such as durable metal or plastic materials. In a preferred embodiment, the urinal 20 and/or urinal holder 100 are constructed from a durable plastic material such as polyethylene. In a particularly preferred embodiment, the male urinal 20 and/or urinal holder 100 are highly visible, being formed of or encapsulated within a fluorescent substance, preferably a substance which glows in the dark. For example, when the urinal 20 and/or urinal holder 100 are formed of a durable plastic material, a fluorescent dye or paint can be mixed with the melted plastic material prior to molding, as will be understood by those of skill in the art. The present invention also contemplates the inclusion of informational materials (e.g., graphs, tables, and diagrams) or recreational materials (e.g., coloring charts for children) on the urinal holder 100. In this latter embodiment, the holder 100 is preferably formed of a write-on material for use by the patient and/or his doctor(s) and attendant(s). Such materials may be incorporated into the device during the manufacturing process or later placed on the device by the consumer.

Obviously, many modifications and variations of the present invention are possible and will be evident to those of ordinary skill in the art. For example, the improved male urinal apparatus preferably incorporates the various embodiments described herein, namely a urinal device having an angularly disposed entrance opening and a urine deflector designed to prevent leakage and spillage, in combination with the urinal holder. However, each of these embodiments may be used individually or in combination to improve existing urinal devices. Moreover, as will be appreciated by those skilled in the art, the urinal and the urinal holder may be packaged and sold together as a unit. When packaged together, the package may include a variety of accessories such as those described hereinabove, and preferably including at least four strips of a Fastener sold under the trademark VELCRO for securing the holder to alternate surfaces and structures.

The foregoing description is considered as illustrative only of the principles of the invention. Furthermore, since numerous modifications and changes will readily occur to those skilled in the art, it is not desired to limit the invention to the exact construction and processes shown as described above. Accordingly, all suitable modifications and equivalents may be resorted to falling within the scope of the invention as defined by the claims with follow.

The embodiments of the invention in which an exclusive property or privilege is claimed are defined as follows:

1. A combination urinal and holder for supporting the urinal on an object in a patient's room, wherein the urinal comprises a housing having an open top wall and a closed bottom wall with a side wall extending between the open top wall and the closed bottom wall and a handle extending laterally outwardly from the side wall, said holder being characterized by:

a rigid container with sidewalls surrounding an interior space and having an open upper end that is large enough to receive said housing of said urinal and a bottom end, one of said sidewalls having an elongated opening that extends from said open upper end toward said bottom end and that is wide enough to accommodate extension of the handle through said elongated opening when the urinal is positioned in said interior space, and a hanger on a different one of said sidewalls of said rigid container than the sidewall that has the elongated opening.

2. The combination urinal and holder of claim 1, wherein said hanger includes a mating loop pile type fastener.

3. The combination urinal and holder of claim 1, wherein said container includes a bottom wall extending between the bottom ends of said sidewalls, and further including a mating loop pile type fastener on said bottom wall of said container.

4. The combination urinal and holder of claim 1, wherein a bottom edge of said elongated opening abuttingly contacts said handle of said urinal when the urinal is positioned in said interior space of said container to at least partially support said urinal within said container in an upright position.

5. The combination urinal and holder of claim 2, said hanger being adapted to extend over and hang on a horizontal portion of a bed railing, the horizontal portion of the bed railing including an attachment element of said mating loop pile type fastener, whereby said holder can be releasably fastened to the bed railing.

6. The combination urinal and holder of claim 4, wherein said container has a depth as measured from said open upper end to said bottom end that is at least as large as the height of said urinal as measured from said open top wall to said closed bottom wall and, further, wherein said elongated opening extends a sufficient distance from said open upper end toward said bottom end of said container so that when said urinal is positioned in said interior space said open top wall of said urinal is received within said interior space of said container.

7. A combination portable urinal and portable urinal holder, comprising:

a urinal comprising a top wall with an opening for receiving a urine stream, a closed bottom wall, and a side wall extending between said top wall and said closed bottom wall, said urinal further including a handle extending laterally outward from said side wall, wherein said top wall extends from said side wall such that said opening in said top wall is at an offset angle from a vertical axis of said urinal when said urinal is positioned with said handle extending upwardly, whereby said urinal captures an upwardly directed stream of urine from a supine patient, and a holder comprising a rigid container with sidewalls surrounding an interior space and having an open upper end that is large enough to receive said urinal and a bottom end, one of said sidewalls having an elongated opening that extends from said open upper end toward said bottom end and that is wide enough to accommodate extension of the handle through said elongated opening when the urinal is positioned in said interior space, and, further including a hanger not on said sidewall of said rigid container that has the elongated opening.

8. The combination of claim 7, said handle having a support portion extending substantially laterally from said side wall of said urinal and a grip portion extending from said support portion substantially parallel to said side wall, and wherein when said urinal is positioned in said interior space said support portion contacts a bottom edge of said elongated opening in said sidewall of said holder and said grip portion extends beyond said bottom edge of said elongated opening in a space exterior to said holder.

9. The combination of claim 7, wherein said offset angle is less than about 90 degrees.

10. The combination of claim 9, wherein said offset angle is in the range of about 20 degrees to 30 degrees.

11. The combination of claim 7, wherein said top wall of said urinal includes a urine deflector adapted to receive the urine stream that passes through said opening and to direct said received urine stream at a channel angle into said urinal.

12. The combination of claim 11, wherein said urine deflector has a curved portion that defines said channel angle, said curved portion having a radius in the range of 2 to 3 inches.

* * * * *